United States Patent [19]

Lasko, deceased et al.

[11] 4,031,668

[45] June 28, 1977

[54] SANDING MACHINE FOR ANATOMICALLY CONTOURED WOODEN CHAIR SEATS AND THE LIKE

[75] Inventors: Robert A. Lasko, deceased, late of Winsted, Conn., by Ruth Lasko, administratrix; Claud T. Miller, Statesville, N.C.

[73] Assignee: Hitchcock Chair Company, Riverton, Conn.

[22] Filed: Feb. 19, 1974

[21] Appl. No.: 659,322

[52] U.S. Cl. ..... 51/137; 51/141; 51/143

[51] Int. Cl.[2] ..... B24B 21/06; B24B 21/16

[58] Field of Search ..... 51/137, 138, 139, 141, 51/143

[56] References Cited

UNITED STATES PATENTS

| | | | |
|---|---|---|---|
| 3,167,889 | 2/1965 | Jacobi | 51/141 |
| 3,283,447 | 11/1966 | Cretsinger | 51/141 |
| 3,374,583 | 3/1968 | Jacobi | 51/141 |
| 3,376,672 | 4/1968 | Schmidt | 51/138 |
| 3,541,736 | 11/1970 | Takekawa | 51/141 |
| 3,570,190 | 3/1971 | Rutt et al. | 51/141 |
| 3,685,219 | 8/1972 | Palmenberg | 51/143 X |
| 3,942,288 | 3/1976 | Schmidt | 51/138 |

*Primary Examiner*—Al Lawrence Smith
*Assistant Examiner*—Nicholas P. Godici
*Attorney, Agent, or Firm*—McCormick, Paulding & Huber

[57] ABSTRACT

A machine for sanding anatomically contoured wooden chair seats and the like comprising a pair of laterally spaced sanding belts, each pulley mounted and power driven and each with a generally longitudinal pass adjacent a work station. A chair seat at the work station is mounted on a laterally movable carriage on spaced rails in turn movable upwardly and downwardly to engage the seat with the belt. A pneumatically inflatable resilient back-up member slidably engages the belt on a side opposite the seat and urges the same toward the seat whereby to cause the belt to conform to the contoured seat surface. Entry and exit guide rollers respectively establish angles of attack and separation for the belt relative to the seat surface. The back-up member is adjustably spring mounted and also has a floating spring support.

10 Claims, 8 Drawing Figures

SANDING MACHINE FOR ANATOMICALLY CONTOURED WOODEN CHAIR SEATS AND THE LIKE

BACKGROUND OF THE INVENTION

Wooden chair seats having anatomically contoured surfaces with generally concave depressions have in the past required a manual belt sanding operation due to the difficulty in causing a sanding belt to conform closely to the contour. While generally satisfactory results have been achieved, the manual sanding operation has of course been relatively time consuming and economic disadvantage in production.

SUMMARY OF THE INVENTION

It is the general object of the present invention to provide a machine for belt sanding anatomically contoured chair seats, the sanding belts and a chair seat support means being operated automatically to complete a sanding operation without manual intervention.

DESCRIPTION OF THE PREFERRED EMBODIMENT

Figure 1:
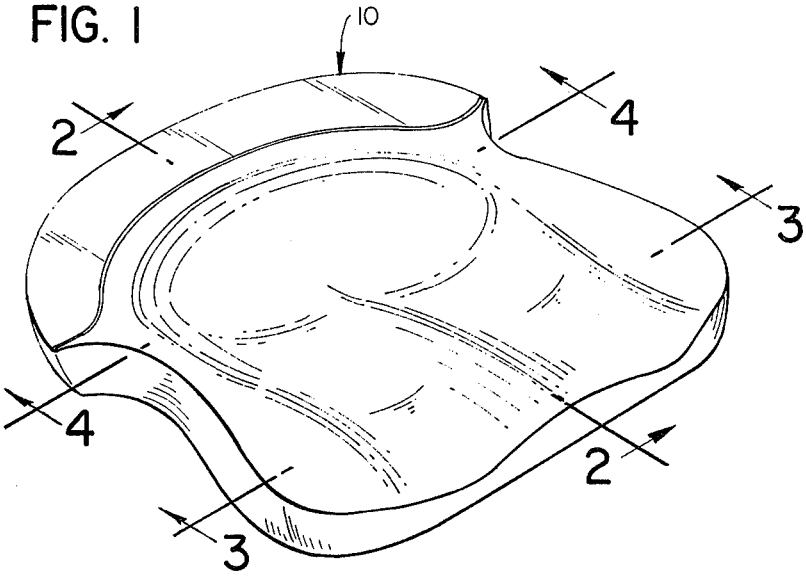
FIG. 1 is a perspective view of an anatomically contoured chair seat of a type which may be automatically sanded by the machine of the present invention.
Figure 2:
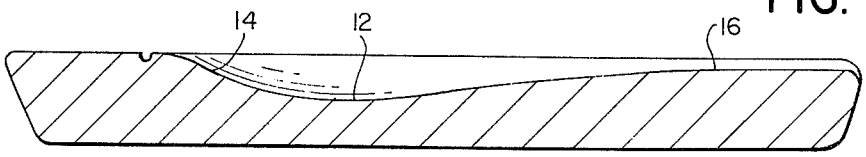
FIG. 2 is a sectional view taken through the chair seat generally as indicated by the lines 2—2 in FIG. 1.
Figure 3:
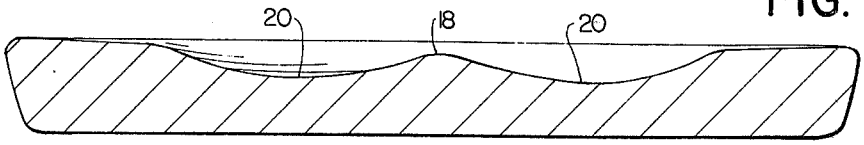
FIG. 3 is a sectional view taken through the chair seat generally as indicated by the lines 3—3 in FIG. 1.
Figure 4:
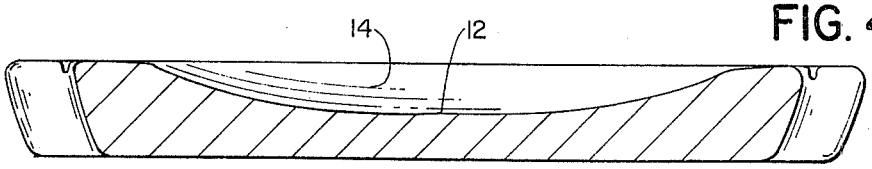
FIG. 4 is a sectional view taken through the chair seat generally as indicated by the lines 4—4 in FIG. 1.
Figure 5:
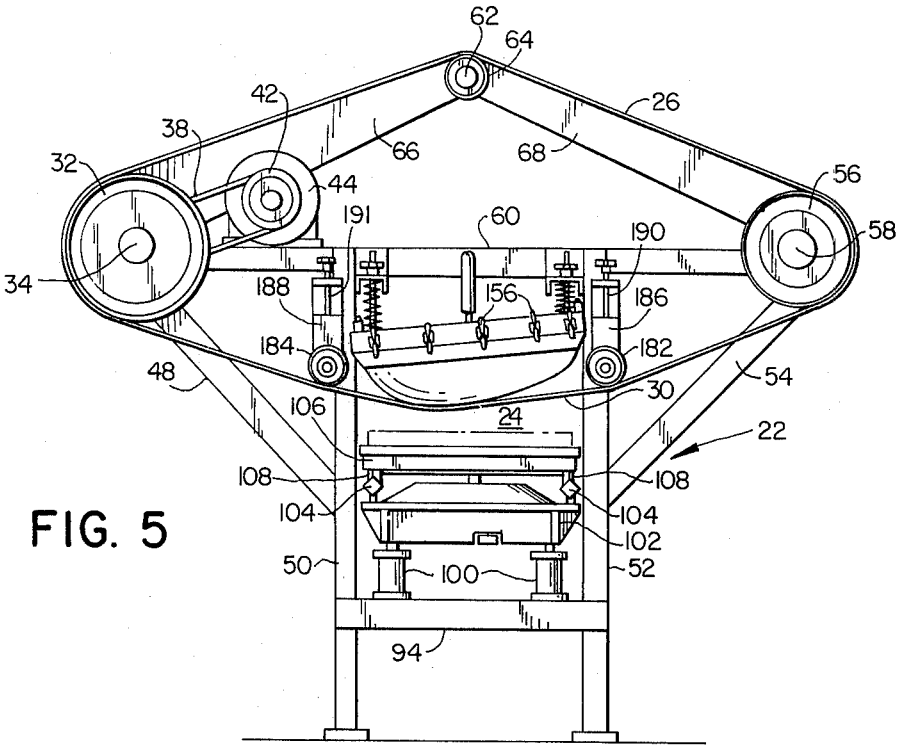
FIG. 5 is a front elevational view of a sanding machine constructed in accordance with the present invention.
Figure 6:
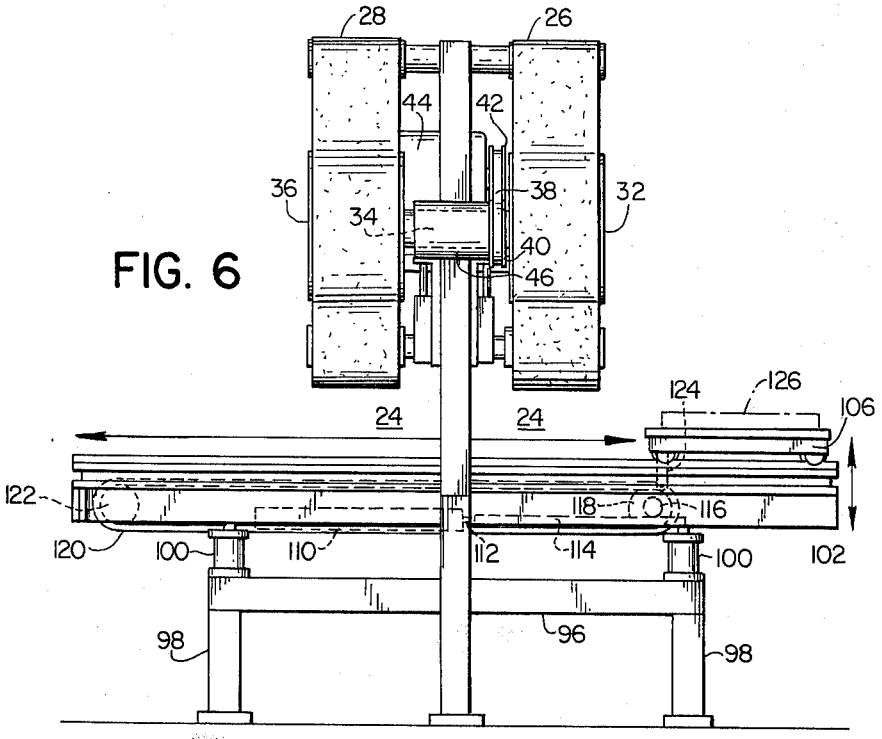
FIG. 6 is a side elevational view of the sanding machine in FIG. 5.

Referring particularly to FIGS. 1 through 4, it will be observed that a wooden chair seat indicated generally at 10 has an anatomically contoured upper surface which may require one or more sanding operations prior to staining, etc. A generally U-shaped depression is at least approximately concave and has a rearwardly disposed portion 12 of maximum depression and which is more closely and uniformly concave but with a relatively sharp arcuate bend at 14. That is, the portion 14 is inclined upwardly at a relatively sharp angle to blend with the upper surface of the chair seat. At a forwardly disposed portion 16 of the contoured surface a somewhat lesser depression is provided and an intermediate separation or rise 18 defines a pair of depressions 20,20 complementary to the under portion of the legs of the individual sitting on the chair seat. The portions 20,20 are shown extending to the forward edge of the seat but this configuration may be varied as in the case of the portion 18. That is, the portion 18 may be eliminated and a single depression provided at a forwardly disposed portion of the seat. Similarly, the overall configuration of the contoured surface may vary widely within the scope of the invention. As will be apparent, relatively complex curvatures are encountered in a sanding operation and for the desired uniformity of sanding, the application of pressure must be carefully controlled in order to avoid excessive sanding at high areas and inadequate sanding at low areas. Referring now particularly to FIGS. 5 and 6, a sanding machine indicated generally at 22 has a work station at 24 or, as best illustrated in FIG. 6, a work station 24 having front and rear sections. That is, the machine 22 is provided with first and second or front and rear sanding belts 26, 28 and a similar sanding operation may be carried out at each of the front and rear sections of the work station. For example, the belt 28 may carry a somewhat finer abrasive than the belt 26, the normal sequence of operation being front to rear. Alternatively, the front or rear belts 26, 28 may be employed individually as will be explained more fully hereinbelow.

Reverting to FIG. 5, it will be observed that the belt 26 has a longitudinal pass 30 which is disposed adjacent the work station 24 and which travels in a generally horizontal portion of the closed loop path of the belt. As shown, the pass 30 of the belt moves from right to left in FIG. 5 and the belt as a whole traverses a generally diamond-shaped closed loop path in a clockwise direction. A drive pulley 32 for the belt is mounted on a shaft 34 which extends rearwardly in the machine and also carries a pulley 36 for driving the belt 28, the latter belt being arranged in a manner identical with that of the belt 26. A small drive belt 38 associated with a pulley 40 on the shaft 34 rotates the shaft 34 and pulleys 32, 36 whereby to drive the sanding belts 26, 28. The belt 38 is driven from a second small pulley 42 on an output shaft of an electric motor 44, FIGS. 5 and 6.

The shaft 34 is journalled at 46, FIG. 6, on a frame member 48 which extends upwardly and angularly outwardly from a vertical frame member 50 at a left hand portion of the machine. A similar right hand vertical frame member 52 has an associated frame member 54 which extends upwardly and angularly outwardly to similarly support a pulley 56 for the belt 26. The pulley 56 is mounted on a small shaft 58 and, rearwardly of the pulley 56 though not shown in FIG. 5, a second identical pulley supports the belt 28.

A horizontal cross frame member 60 extends between the frame members 48 and 54 and disposed centrally thereabove is a shaft 62 carrying an idler pulley 64 over which the belt 26 passes. At a rear end portion the shaft 62 also carries an idler pulley 65 for the belt 28, FIG. 6. Left and right hand upwardly and inwardly inclined frame members 66, 68 extend respectively from the frame members 48, 54 and journal the shaft 62 at their junction.

The belts 26, 28 may be of a conventional construction and, as indicated above, the rear belt 28 may carry a somewhat finer abrasive than the belt 26.

Figure 8:
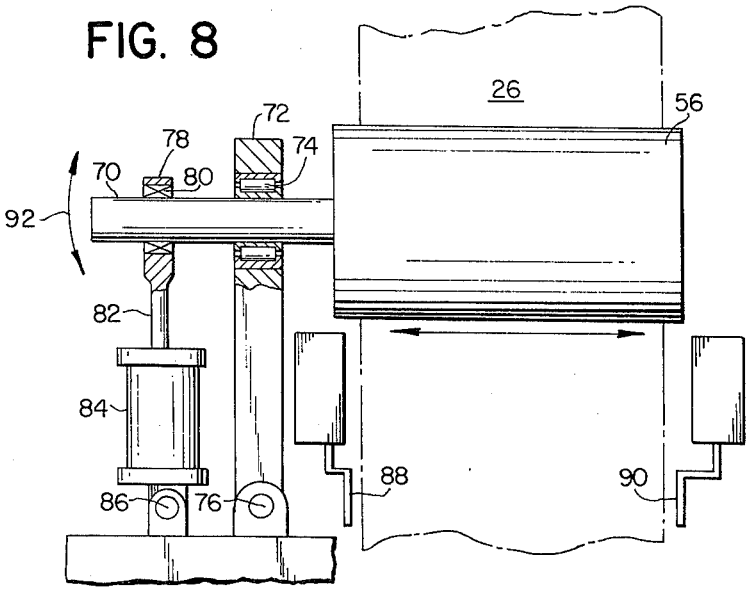
FIG. 8 is an enlarged fragmentary side elevational view of a belt aligning device in the sanding machine of the present invention.

In order to maintain proper alignment of the belts during operation a belt aligning device may be provided and separate shafts for the pulley 56 and the identical pulley therebehind may be employed. That is, belt aligning devices may be required to resist the tendency of the belts to ride laterally off or askew their respective pulleys. Any of a wide variety of aligning devices may be employed for each of the pulleys and the device of FIG. 8 should be regarded as an illustrative example only. In FIG. 8, the pulley 56 is mounted on a stub shaft 58 in cantilever fashion. That is, a mounting member 72 provided with bearing 74 supports the shaft and is pivotally supported at its base at 76. A second mounting member 78 provided with bearings at 80 is disposed at an outer end portion of a piston rod 82 in a fluid operable cylinder 84 also pivotally mounted at 86. Left and right hand feelers 88, 90 sense the movement of the belts 26 laterally with respect to the pulley 56 respectively in left and right hand directions and through suitable controls not shown operate the cylinder 84 as required to incrementally swing the pulley in counterclockwise or clockwise directions about a horizontal axis as indicated by the arrow 92. As the pulley is thus inclined slightly in response to an incipient lateral movement of the belt 26 the belt is caused to move back toward its central or aligned position and any excessive lateral movement or misalignment of the belt is thus avoided.

At a lower portion of the machine 22, a generally rectangular frame subassembly is provided with a front horizontal cross piece 94 connected at opposite ends with left and right hand rearwardly extending frame members, one shown at 96 in FIG. 6. A rear cross piece similar to the front cross piece 94 interconnects the side frame members and four short legs 98,98 support the rectangular frame thus formed respectively at its four corners. Also at each of the corners a small fluid operated cylinder 100 is provided and is arranged vertically with its base disposed downwardly and with its piston rod disposed upwardly and in supporting engagement with a generally rectangular frame 102. The frame 102 extends from front to rear in the machine and supports a pair of spaced elongated carriage rails 104,104 which similarly extend from front to rear.

Mounted atop the carriage rails 104,104 and movable forwardly and rearwardly therealong is a chair seat carriage 106. The carriage may vary in form but preferably has four small V-shaped wheels 108,108 which ride on the carriage rails 104,104, the latter preferably being diamond-shaped in cross section. Disposed beneath the frame 102 as best illustrated in FIG. 6 is a fluid operated cylinder 110 which has a piston rod extending horizontally at 112 and carrying a horizontal rack 114. The rack 114 drives a pinion 116 which in turn rotates a sprocket 118 in one and an opposite direction. A chain 120 associated with the sprocket is thus driven thereabout and about a rearwardly disposed sprocket 122. Thus, it will be apparent that a short link 124 depending from the carriage 106 and connected with the chain 122 can serve to move the carriage 106 forwardly and rearwardly along the rails 104.

On extension of the rod 112 and rack 114 rightwardly in FIG. 6, causing a counterclockwise rotation of the pinion 116 and sprocket 118, the chain 120 will be driven in a counterclockwise rotation whereby to cause the carriage 106 to be moved rearwardly along its support rails 104,104. Conversely, the carriage 106 can be moved forwardly along its rails by retraction of the rod 112 and rack 114. Suitable valve and control means (not shown) may be provided to operate the cylinder 110 whereby to move the carriage 106 from the position shown rearwardly beneath the belts 26 and 28 sequentially or, the carriage may be moved beneath either of the belts individually. Further, control means for the cylinders 100,100 provide for the vertical upward movement of the frame 102 and the carriage 106 beneath one or both of the belts 26, 28.

Figure 7:
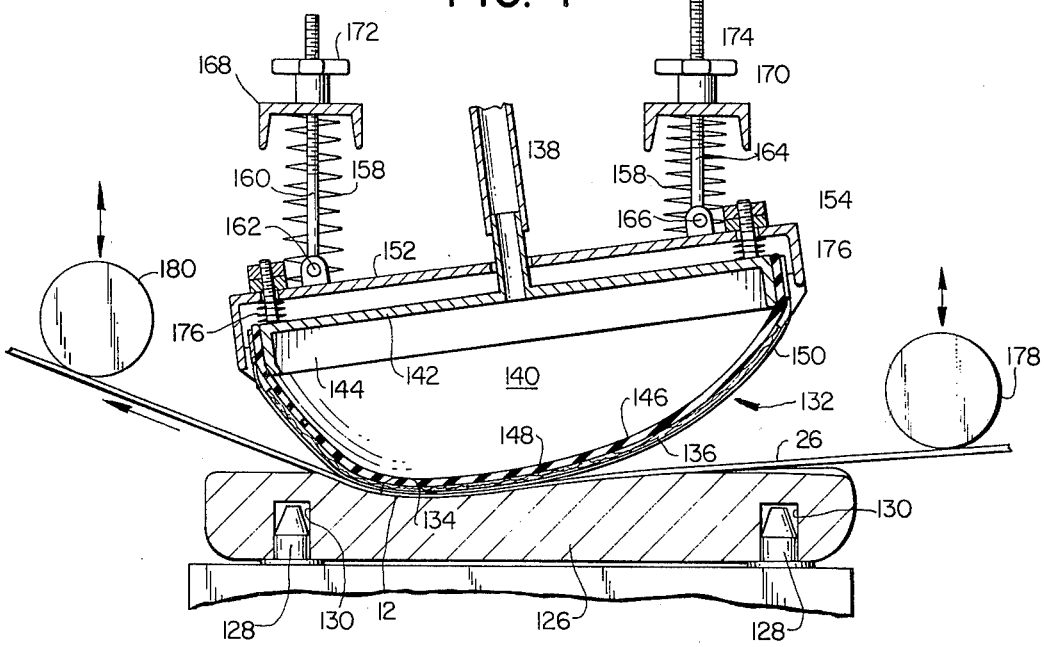
FIG. 7 is an enlarged fragmentary sectional view of a work station in the sanding machine of FIGS. 5 and 6.

As will be apparent, a chair seat such as indicated at 126, may be mounted on the carriage 106 by suitable upright pins 128,128 entering the leg openings 130,130 in the chair seat, FIG. 7. With the seat so mounted, the carriage 106 can be raised by operation of the cylinders 100,100 and moved rearwardly by operation of the cylinder 110 whereby to engage the belts 26 and 28 sequentially or, the cylinders 100,100 may be operated to move the frame 102 and carriage 106 upwardly and downwardly as required to engage the chair seat with the belts individually. After sanding, the carriage may be lowered and moved forwardly to the position shown for unloading or, alternatively, the carriage may be maintained in an upper position such that the seat will be engaged with either one or both of the belts 26, 28 on its forward traverse for further sanding operations.

In order that the sanding belts may engage the chair seats with the desired pressure and in a uniform manner, resilient backup members are provided for the belts and each such member operates in conjunction with at least one and preferably a pair of guide rollers. A similar arrangement is provided for each of the belts 26 and 28 but the arrangement for the belt 26 only is shown and described herein, it being understood that the arrangement for the belt 28 is or may be identical. As best illustrated in FIG. 7, a resilient backup member 132 takes a generally convex shape and engages the sanding belt at the work station on a side of the belt opposite the chair seat 126. More particularly, the backup member is generally convex but has a region of maximum elevation at 134 which is disposed generally opposite and in registry with the aforesaid region of maximum depression 12 in the chair seat, the sanding belt thus being urged into conformity with the contour of the seat in this region. The region 134 of the backup member has a somewhat sharper arcuate contour than the portion thereof at the opposite end 136 and the member is asymmetrical and arranged in an inclined attitude so as to more effectively urge the belt into the depression 12. The overall configuration of the backup member is generally pillow-like and the lower side edge portions thereof are rounded as are the lower opposite end portions thereof illustrated in FIG. 7.

Various resilient constructions may be provided for the backup member 132 within the scope of the invention but optimum results have been achieved with a pneumatically inflatable member or air bag. Thus, an air line 138 leads to a source of air under pressure and communicates with a chamber 140 beneath a rectangular plate 142 having a depending skirt 144. The inflatable member or air bag is open at the top and surrounds the skirt or flange 144, the said member or bag being identified more specifically by the reference numeral 146. Disposed outwardly of and in overlying engagement with the air bag 146 is a layer 148 which is preferably of felt or the like and an outermost layer 150 which is of a low friction material such as graphite. The low friction material provides for sliding engagement between the belt 126 and the backup member with a minimum of wear. An outer plate or housing member 152 disposed above the member 142 also has a skirt or depending flange 154 which is disposed about the upper end portions of the bag 146, belt 148 and graphite 150. Small clamp members 156,156, FIG. 5, secure the free edge portions of the air bag, felt and graphite in position between the two flanges or skirts 144, 154.

As mentioned, the air bag is preferably inclined from the horizontal for proper entry of its end portion 134 in the seat portion 12 and, such an attitude of the air bag is preferably adjustable and maintained under resilient pressure. That is, four vertical adjustment springs 158,158 are provided approximately at the corners of the plate 152. A threaded rod 160 is pivotally connected with the plate at 162 and a rod 164 is similarly connected at 166. At upper portions, the rods 160, 164 pass freely through openings in brackets 168 and 170 which are rigidly mounted on the machine frame. The rods 160, 164 are threadably engaged with small hand wheels 172, 174 above and in engagement with the brackets 168, 170. Thus, it will be apparent that the springs 158,158 are maintained in compression beneath the brackets 168, 170 whereby to urge the backup member 132 downwardly. The hand wheels 172, 174 may be manually manipulated whereby to adjustably position the backup member 132 at a desired vertical position and attitude, the latter of which may be horizontal or inclined from the horizontal.

In addition to the springs 158,158, four additional springs 176,176 are preferably provided between the plates 142 and 152. The said springs are maintained under slight compression and serve as lightweight backup springs for a floating support of the resilient backup members. Thus, the springs 158,158 and 176,176 cooperate to adjust the pressure exerted by the backup member 132 on the sanding belt 26 and thus provide the desired pressure and uniformity in the sanding operation.

As mentioned, at least one guide roller is preferably provided and two such rollers are illustrated in the drawings. An entry guide roller 178 engages the belt 26 on a side thereof opposite the chair seat 126 and at a location spaced rightwardly from the seat whereby to establish an angle of attack for the belt relative to the chair seat surface. Thus, the sanding of the seat is regulated at an area on the right hand or upstream side of the region of maximum depression. As illustrated, the belt 26 is allowed to approach the chair seat at a relatively sharp angle such that it does not engage the right hand edge portion of the seat. In the particular sanding operation illustrated, the edge portion of the seat is not sanded but it will be obvious that it may be sanded in a next succeeding or previous operation, downward adjustment of a similar entry guide roller being accomplished for such purpose.

An exit guide roller 180 serves to establish the angle at which the sanding belt 26 departs from the work station and thereby establishes an angle of sepration for the belt relative to the chair seat. In the present instance the left hand edge portion of the seat is not sanded in the operation shown but may be sanded in a previous or subsequent operation. For example, it will be obvious that the guide roller 180 may be lowered and the backup member 132 somewhat elevated to accomplish a lesser degree of sanding at the depressed area 12 and to accomplish sanding of the left hand edge portion of the seat. Various cooperative arrangements of the rollers 178, and 180 and the backup member 132 may be employed in achieving the desired sanding operation.

The manner in which the guide rollers 178 and 180 are arranged may, of course, vary but preferably, the said rollers are secured as illustrated in FIG. 5. Short shafts 182 and 184 are mounted respectively on frame brackets 186, 188 and carry the rollers, threaded adjusting rods being provided at 190 and 191.

It will be apparent from the foregoing that a desirably simple and reliable construction has been provided for an automatic sanding machine and yet a high degree of versatility is achieved. With the backup member 132 and the entry and exit guide rollers cooperatively adjusted various operations can be accomplished on a chair seat or the like having complex surface contours. Simple manual adjustments are provided for the set-up operation and the machine may thereafter be operated automatically with suitable electrical controls regulating the fluid cylinders as described above. Efficient and uniform sanding of the seats is achieved and a significant improvement in production rates is realized on the order of three or four to one.

It is claimed:

1. In a machine for belt sanding anatomically contoured chair seats and the like having generally concave depressions therein with arcuate surfaces viewed along each of two perpendicular axes, the combination comprising a work station, a sanding belt having at least one abrasive side and which follows a closed loop path with a longitudinal pass adjacent the work station, pulley and associated drive means for supporting the belt at spaced locations internally of the loop and for driving the same through its said path, means for supporting a chair seat with its anatomically contoured surface to be sanded facing toward an abrasive side of the belt at said work station and with one of said axes in substantial alignment with said longitudinal belt pass, said chair seat support means being movable toward and away from and generally perpendicular to the plane of said longitudinal belt pass to cause a chair seat thereon to selectively engage the belt, and said support means also being movable laterally with respect to and generally parallel to the plane of said longitudinal belt pass along the other of said axes whereby the chair seat can be progressively sanded in movement across the belt, a pneumatically inflatable generally pillow-like resilient back-up member having a generally convex pressure surface with both lower side and end edge portions having a rounded configuration, said member being disposed at said work station on a side of said belt opposite said chair seat, a regulable source of air under pressure in communication with the interior of said resilient member and serving to inflate the same, said member when inflated being resilient along each of said axes and serving to slidably engage the belt and urge the same toward the seat thereby causing the belt to conform to and sand said contoured seat along the arcuate surfaces of each of said axes, and at least one guide roller disposed adjacent the sanding belt on the same side as said resilient back-up member but spaced longidutinally from said member, said roller being mounted for adjustment toward and away from the belt whereby to vary the belt angle relative to both the resilient member and a chair seat being sanded and thus to control belt engagement with the seat and sanding thereof in an area adjacent the area of engagement between the resilient member and the belt.

2. The combination in a sanding machine as set forth in claim 1 wherein said one guide roller is provided adjacent and in engagement with the sanding belt on the same side as the resilient member as the belt approaches the work station, said roller cooperating with the resilient member to establish an angle of attack for the belt relative to the chair seat surface to be sanded and thus regulating the sanding of the seat at an area of an upstream side of said area of engagement between the resilient member and the belt.

3. The combination in a sanding machine as set forth in claim 2 wherein at least one additional guide roller is provided adjacent and in engagement with the sanding belt on the same side as the resilient member but as the belt departs from the work station, said roller cooperating with the resilient member to establish an angle of separation for the belt relative to the chair seat surface to be sanded and thus regulating the sanding of the seat at an area on a downstream side of said area of engagement between the resilient member and the belt.

4. The combination in a sanding machine as set forth in claim 1 wherein said resilient member is asymmetrical viewed from one side of the belt with a somewhat sharper arcuate contour at one end than at the other, and wherein said member is adjustably supported so as to tiltably position said one end toward and away from the belt.

5. The combination in a sanding machine as set forth in claim 1 wherein a mounting plate is provided for said resilient member and held by four spaced spring adjustment means for adjustable support of the resilient member.

6. The combination in a sanding machine as set forth in claim 5 wherein four spaced additional lightweight backup springs are provided for a spring biased floating support of said resilient member.

7. The combination in a sanding machine as set forth in claim 1 wherein said machine includes a pair of laterally spaced sanding belts, and wherein said support means transports the chair seat laterally into sequential engagement with said belts.

8. The combination in a sanding machine as set forth in claim 7 wherein said chair support means comprises a carriage movable laterally in one and an opposite direction along spaced carriage rails and means for bodily moving said rails and carriage toward and away from said sanding belts.

9. The combination in a sanding machine as set forth in claim 1 wherein said pneumatically inflatable resilient member is of an elastomeric material, and wherein said outermost layer of material has a graphite surface.

10. The combination in a sanding machine as set forth in claim 9 wherein a soft pad is interposed between said elastomeric member and said outermost member.

* * * * *